US011229283B2

(12) United States Patent
Gontarz et al.

(10) Patent No.: US 11,229,283 B2
(45) Date of Patent: Jan. 25, 2022

(54) BRUSH WITH FLUID DELIVERY

(71) Applicant: Colgate-Palmolive Company, New York, NY (US)

(72) Inventors: Gerald Gontarz, Spotswood, NJ (US); Patrik Johansson, Hoboken, NJ (US); John Gatzemeyer, Hillsborough, NJ (US); Douglas Hohlbein, Hopewell, NJ (US); Daniel Wainless, New Brunswick, NJ (US); Brian Bloch, Hillsborough, NJ (US); Najma Khan, Somerset, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 16/848,992

(22) Filed: Apr. 15, 2020

(65) Prior Publication Data

US 2020/0237090 A1 Jul. 30, 2020

Related U.S. Application Data

(63) Continuation of application No. 16/066,016, filed as application No. PCT/US2015/067695 on Dec. 28, 2015, now Pat. No. 10,681,976.

(51) Int. Cl.
*A46B 11/00* (2006.01)
*A46B 9/04* (2006.01)
(Continued)

(52) U.S. Cl.
CPC ..... *A46B 15/0022* (2013.01); *A45D 34/042* (2013.01); *A46B 9/04* (2013.01);
(Continued)

(58) Field of Classification Search
CPC ... A61C 17/225; A61C 17/227; A46B 11/001; A46B 11/002; A46B 11/0041;
(Continued)

(56) References Cited

U.S. PATENT DOCUMENTS 35,316 A 5/1862 Howard
846,900 A 3/1907 Bloom
(Continued)

FOREIGN PATENT DOCUMENTS

CN 2105213 5/1992
CN 101641032 2/2010
(Continued)

OTHER PUBLICATIONS

International Search Report and Written Opinion of the International Searching Authority in International Application No. PCT/US2015/067695, dated Aug. 25, 2016.

*Primary Examiner* — Patrick M. Buechner

(57) ABSTRACT

A toothbrush includes a handle, a head at a distal end of the handle comprising a bristle plate, a hole extending through the bristle plate, a plurality of bristles at least partially disposed in the hole and extending from the hole in a direction away from the head, and a reservoir in fluid communication with the hole. Fluid in the reservoir enters the tuft holes and is wicked out of the head of the toothbrushes by capillaries formed between the bristles.

9 Claims, 7 Drawing Sheets

(51) Int. Cl.

| | |
|---|---|
| ***A46B 3/16*** | (2006.01) |
| ***A46B 15/00*** | (2006.01) |
| ***C25B 1/00*** | (2021.01) |
| ***C25B 9/17*** | (2021.01) |
| ***C25B 11/02*** | (2021.01) |
| ***A45D 34/04*** | (2006.01) |
| *A46B 3/06* | (2006.01) |

(52) U.S. Cl.
CPC ..... *A46B 11/0082* (2013.01); *A46B 11/0086* (2013.01); *A46B 15/0024* (2013.01); *C25B 1/00* (2013.01); *C25B 9/17* (2021.01); *C25B 11/02* (2013.01); *A46B 3/06* (2013.01); *A46B 3/16* (2013.01); *A46B 2200/104* (2013.01); *A46B 2200/1066* (2013.01); *A46B 2200/3033* (2013.01)

(58) Field of Classification Search
CPC ..... A46B 11/0055; A46B 11/0082; A46B 11/0086; A46B 15/0022; A46B 15/0024
See application file for complete search history.

(56) References Cited

U.S. PATENT DOCUMENTS 991,798 A 5/1911 Orthwein
1,142,566 A 6/1915 Jackson
1,598,968 A * 9/1926 Johnson ..... A46B 11/001 15/191.1
1,797,946 A 3/1931 Eichel
1,798,081 A 3/1931 Gordyn, Jr. et al.
1,800,437 A 4/1931 Crouch
1,809,330 A 6/1931 Dorrance et al.
1,896,982 A 2/1933 Talbot
1,973,212 A 9/1934 Krueger
2,235,637 A 3/1941 Hickey
2,268,928 A 1/1942 Duey
2,274,790 A 3/1942 Housley
2,278,253 A 3/1942 Ellsworth
2,305,158 A 12/1942 Hanses
2,306,482 A 12/1942 Livingston
2,308,078 A 1/1943 Hendrickson
2,323,378 A 7/1943 Champion
2,328,048 A 8/1943 Bair
2,443,055 A * 6/1948 Reis, Jr. ..... A46D 1/00 15/207.2
2,569,276 A 9/1951 Baptist
2,587,794 A 3/1952 Walker et al.
2,594,721 A 4/1952 Beebe
2,617,431 A * 11/1952 Gaspari ..... A45D 24/22 132/120
2,628,001 A 2/1953 Sarnoff
2,631,762 A 3/1953 Perwas
2,674,000 A 4/1954 McDonald, Jr.
2,715,236 A 8/1955 Tereno
2,743,042 A 4/1956 Burgin
2,793,380 A 5/1957 Brown et al.
2,807,818 A 10/1957 Taylor
2,809,386 A 10/1957 Asturias, Jr.
2,826,775 A 3/1958 Psilos
2,836,839 A 6/1958 Julian
2,971,518 A 2/1961 O'Neal
2,978,722 A 4/1961 Kusakabe
3,187,758 A 6/1965 Eklund
3,217,720 A 11/1965 Cyzer
3,256,894 A 6/1966 Sherman
3,400,996 A 9/1968 Vandergrift
3,465,376 A * 9/1969 Smith ..... A46B 11/063 15/104.92
4,039,261 A 8/1977 Evans
4,145,147 A 3/1979 Schuck
4,176,980 A 12/1979 O'Neal et al.
4,530,369 A 7/1985 Adams
4,934,855 A 6/1990 Recchelbacher
4,963,046 A 10/1990 Eguchi
4,969,868 A 11/1990 Wang
5,061,106 A 10/1991 Kent
5,062,728 A 11/1991 Kuo
5,309,590 A 5/1994 Giuliani et al.
5,346,324 A 9/1994 Kuo
5,462,377 A 10/1995 Martinez, Jr. et al.
5,476,384 A 12/1995 Giuliani et al.
5,758,984 A 6/1998 Doherty
5,769,585 A 6/1998 Podolsky
5,827,001 A 10/1998 Taghavi-Khanghah
5,909,977 A 6/1999 Kuo
5,975,090 A 11/1999 Taylor et al.
6,022,163 A 2/2000 Asfur
6,056,466 A 5/2000 Johnson et al.
6,164,967 A 12/2000 Sale et al.
6,257,791 B1 7/2001 Scamard
6,644,878 B2 11/2003 Hall et al.
6,889,401 B2 5/2005 Fattori et al.
6,948,875 B1 9/2005 Jang
7,021,851 B1 4/2006 King
7,703,163 B2 4/2010 Jimenez et al.
7,722,278 B2 5/2010 Black
7,857,623 B2 12/2010 Grez
8,075,216 B2 12/2011 Gatzemeyer et al.
8,082,886 B2 12/2011 Hurwitz
8,156,602 B2 4/2012 Jimenez et al.
8,281,448 B2 10/2012 Waguespack et al.
8,398,325 B2 3/2013 Wu et al.
8,398,326 B2 3/2013 Jimenez et al.
8,448,651 B2 5/2013 Honnefeller et al.
8,517,728 B2 8/2013 Gatzemeyer et al.
8,647,007 B2 2/2014 Kuo
8,668,397 B2 3/2014 Barkhordar
8,740,490 B2 6/2014 Kuo
8,920,168 B2 12/2014 Gatzemeyer et al.
9,033,602 B2 5/2015 Boyd et al.
9,138,047 B2 9/2015 Boyd et al.
9,332,830 B1 5/2016 Thompson
9,364,067 B2 6/2016 Pham
9,565,927 B2 2/2017 Bloch et al.
9,603,444 B2 3/2017 Boyd et al.
9,839,283 B2 12/2017 Tatu et al.
10,021,963 B2 7/2018 Johnson
10,179,038 B2 1/2019 Johansson et al.
10,638,832 B1 * 5/2020 Davies-Smith ..... A46B 9/04
2005/0147461 A1 7/2005 Glover
2005/0193512 A1 * 9/2005 Moskovich ..... A46B 5/0029 15/167.1
2007/0183838 A1 8/2007 Umar
2007/0231052 A1 10/2007 Latour et al.
2009/0119859 A1 5/2009 Podolsky
2011/0070016 A1 3/2011 Richardson
2011/0296643 A1 12/2011 Shepherd et al.
2011/0304194 A1 12/2011 Uchida et al.
2012/0233791 A1 9/2012 Uchida et al.
2013/0205529 A1 8/2013 Flesch
2014/0349246 A1 11/2014 Johnson et al.
2015/0157122 A1 6/2015 Prescott
2016/0120298 A1 * 5/2016 Grewal ..... A46B 3/04 15/167.1
2018/0368565 A1 12/2018 Wainless et al.
2018/0368566 A1 12/2018 Wainless et al.

FOREIGN PATENT DOCUMENTS

| | | |
|---|---|---|
| CN | 201398624 | 2/2010 |
| CN | 102232698 | 11/2011 |
| CN | 202457036 | 10/2012 |
| DE | 451728 | 11/1927 |
| JP | S58-163309 | 9/1983 |
| JP | H04-215706 | 8/1992 |
| JP | H06-090824 | 4/1994 |

* cited by examiner

BRUSH WITH FLUID DELIVERY

CROSS-REFERENCE TO RELATED APPLICATIONS

The present application is a continuation of U.S. patent application Ser. No. 16/066,016, filed Jun. 25, 2018, which is a national stage entry under 35 U.S.C. § 371 of PCT/US2015/067695, filed Dec. 28, 2015, the entireties of which are incorporated herein by reference.

BACKGROUND

Toothbrushes are ubiquitous. Conventionally, toothbrushes are used in conjunction with a dentifrice, such as a toothpaste, a gel, a powder, a fluid, or other composition. The dentifrice is generally provided separately from the toothbrush, such as in a tube or other container and the user applies the dentifrice to the toothbrush prior to using. Dentifrices are known to provide a number of oral health benefits, including freshening breath, enhancing tooth whitening, killing bacteria, and more. However, it would be desirable to provide a toothbrush that provides similar benefits from a dentifrice solution that does not need to be applied to the toothbrush at each use.

Accordingly, there is a need in the art for a toothbrush that provides oral health benefits via a dentifrice or other oral care solution that does not need to be applied to the toothbrush.

For example, there is a need in the art for a toothbrush that contains and automatically delivers a dentifrice or other oral care solution while a user brushes her teeth. More generally, there is a need for a brush that contains and automatically delivers a fluid, solution, or other composition during use.

BRIEF SUMMARY

In aspects of this disclosure, a toothbrush includes a handle, a head at a distal end of the handle and comprising a bristle plate, a hole extending through the bristle plate, a plurality of bristles at least partially disposed in the hole and extending from the hole in a direction away from the head, and a reservoir in fluid communication with the hole.

In one aspect of the disclosure, a toothbrush include a handle; a head at a distal end of the handle and comprising a bristle plate; a hole extending through the bristle plate; a plurality of bristles at least partially disposed in the hole and extending from the hole in a direction away from the head; and a reservoir in fluid communication with the hole.

In another aspect, in a toothbrush according to any of the preceding paragraphs, a wick is disposed in the reservoir.

In another aspect, in a toothbrush according to any of the preceding paragraphs, the plurality of bristles comprise a bristle tuft.

In another aspect, in a toothbrush according to any of the preceding paragraphs, a staple retains the bristle tuft in the hole.

In another aspect, in a toothbrush according to any of the preceding paragraphs, a conduit fluidly connects the reservoir to the hole.

In another aspect, in a toothbrush according to any of the preceding paragraphs, at least a portion of the reservoir is disposed in the handle.

In another aspect, in a toothbrush according to any of the preceding paragraphs, a valve is disposed between the reservoir and the hole.

In another aspect, in a toothbrush according to any of the preceding paragraphs, the plurality of bristles is supported on a melt matte disposed on a side of the top surface opposite a side from which the plurality of bristles extend.

In another aspect, in a toothbrush according to any of the preceding paragraphs, the melt matte is porous and the melt matte is in fluid communication with the reservoir.

In another aspect, in a toothbrush according to any of the preceding paragraphs, a dentifrice or other oral care solution is contained in the cavity.

In another aspect, in a toothbrush according to any of the preceding paragraphs, the dentifrice or other oral care solution comprises a film-forming polymer.

In another aspect, in a toothbrush according to any of the preceding paragraphs, a wick is disposed in the reservoir.

In another aspect, in a toothbrush according to the preceding paragraph, the wick extends into the handle.

In another aspect, in a toothbrush according to either of the preceding two paragraphs, the wick is movable between a first position contacting the bristles and a second position spaced from the bristles.

In another aspect, in a toothbrush according to any of the preceding three paragraph, the wick has a cross-section comprising a flat portion and an arcuate portion and is selectively rotatable about an axis between a first position in which the arcuate portion of the wick contacts the bristles and a second position in which the arcuate portion of the wick is spaced from the bristles.

In another aspect, in a toothbrush according to any of the preceding paragraphs, a pair of electrodes is disposed in the cavity; and a power source arranged to provide an electrical potential between the pair of electrodes.

In another aspect of this disclosure, a brush includes a handle; a head at a distal end of the handle, the head comprising a housing having an inner surface at least partially defining a cavity and an outer surface spaced from the inner surface; a plurality of holes extending from the outer surface of the housing to the inner surface of the housing; and a tuft of bristles associated with each of the plurality of holes, the tuft of bristles disposed partially in a respective hole and extending from the hole past the outer surface to extend from the head.

In another aspect, in a brush according to the preceding paragraph, the handle comprises an opening in fluid communication with the cavity.

In another aspect, in a brush according to any of the preceding paragraphs, a wick is disposed in the cavity.

In another aspect, in a brush according to any of the preceding paragraphs, a plurality of staples is provided, each of the staples retaining a respective bristle tuft in the respective hole.

In another aspect, in a brush according to any of the preceding paragraphs, the plurality of bristles extends from a melt matte disposed in the cavity.

In another aspect, in a brush according to any of the preceding paragraphs, the melt matte is porous.

In another aspect, in a brush according to any of the preceding paragraphs, a valve disposed in the cavity.

In another aspect, in a brush according to any of the preceding paragraphs, a deformable member pressurizes a portion of the cavity to force fluid through the valve.

Further areas of applicability of the present invention will become apparent from the detailed description provided hereinafter. It should be understood that the detailed description and specific examples, while indicating presently preferred embodiments of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

This description of presently preferred embodiment(s) is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

This disclosure relates generally to brushes, and more particularly to brushes that include tufts of bristles capable of conveying, via capillary action, a fluid from a reservoir in fluid communication with the bristles. Spaces between bristles comprising a tuft of bristles act as capillaries to wick fluid from the reservoir and out of the brush head. While examples of the following detailed description generally refer to embodiments of the inventive implements in the context of a toothbrush, the disclosure is not limited to toothbrushes; other implements may also incorporate features of this disclosure. By way of non-limiting example, hair brushes that have tufts of bristles are known, and aspects of this disclosure may be incorporated into such implements. Moreover, features of the disclosure may be incorporated into other health-related applications such as, for example but not limited to, personal care brushes (such as for application of soap, body wash, or in-shower moisturizers) or home care brushes (such as for application of dish, kitchen, or bath cleaning compositions).

Figure 1A:
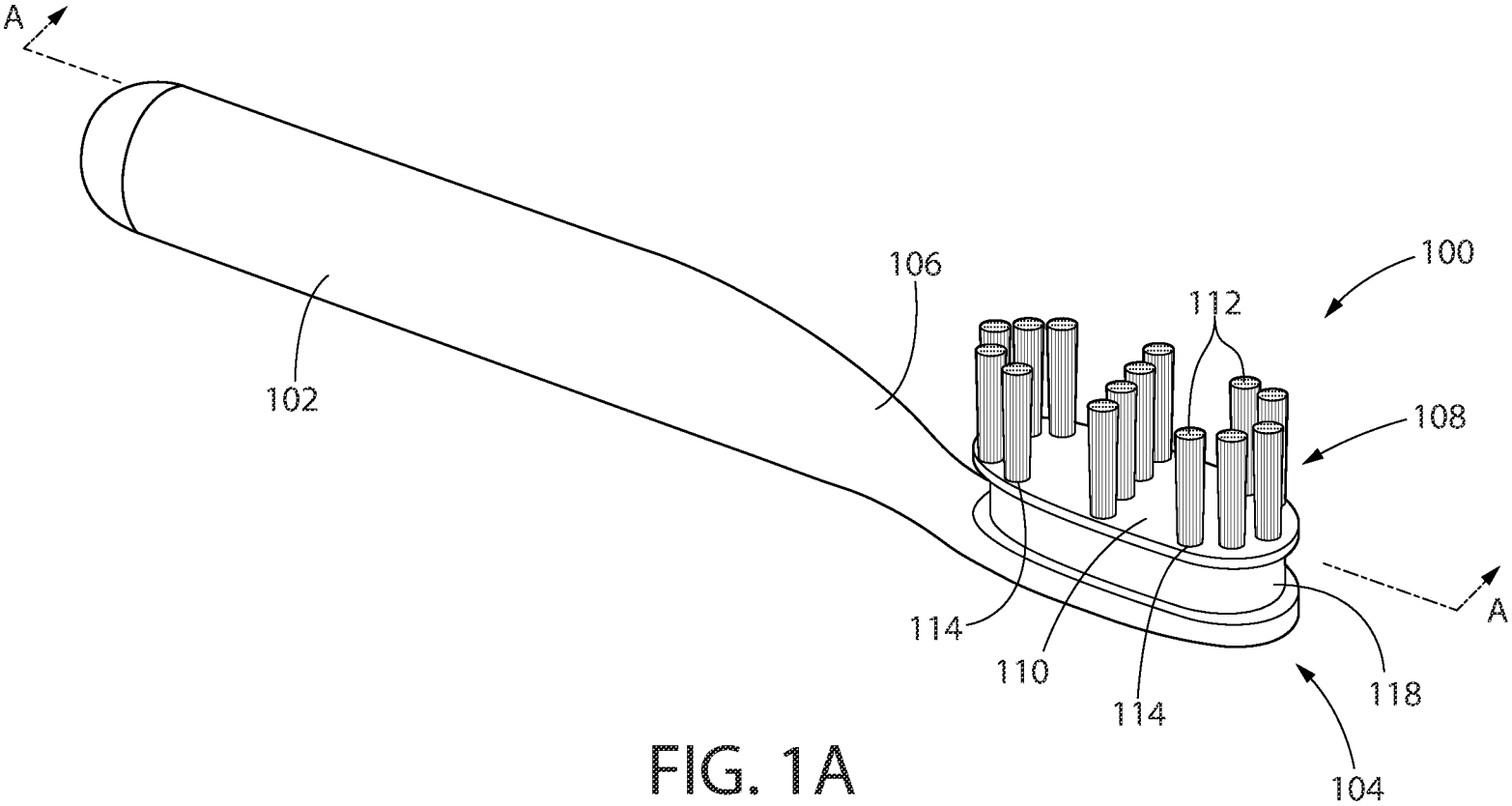
FIG. 1A is a perspective view of a toothbrush according to an example implementation of this disclosure.

FIG. 1 illustrates a toothbrush 100 according to a first implementation of this disclosure. The toothbrush 100 generally includes a handle 102, a head 104 disposed at the distal end of the handle 102, and a neck portion 106 generally disposed between the handle 102 and the head 104. As illustrated, the handle 102 has a generally elongate shape, along a longitudinal axis. This disclosure is not limited to the shape and/or size of the toothbrush 100 illustrated in FIG. 1. In alternative implementations, one or more of the handle 102, head 104, and/or neck 106 may have different shapes, sizes, orientations, and/or the like. Additional features may also be incorporated into the toothbrush or disposed on the toothbrush.

In the embodiment illustrated in FIG. 1, the head 104 of the toothbrush 100 also includes a plurality of bristles 108 extending from a top surface 110 of the head 104. As illustrated, the bristles 108 are provided as a plurality of bristle tufts 112 each of the tufts being disposed in, and extending form, a tuft hole 114. The bristles 108 are commonly used or are suitable for use to provide oral health benefits (e.g., tooth cleaning, tooth polishing, tooth whitening, massaging, stimulating, etc.) by making intimate contact with portions of the teeth and/or gums. The tufts may be formed with bristles of the same or different bristle materials (such as nylon bristles, spiral bristles, rubber bristles, etc.). Moreover, while the bristles 108 may be arranged so that they are generally perpendicular to the top surface 110 of the head 104, some or all of the bristles may be angled at various angles with respect to that surface. When the tooth cleaning elements 108 includes bristle tufts, it is thereby possible to select the combination of bristle configurations, bristle materials and/or bristle orientations to achieve specific intended results and operational characteristics, thus maximizing and enhancing cleaning, tooth polishing, tooth whitening, massaging, stimulation, and the like. In some aspects of the disclosure, however, several of the bristles within each tuft are substantially parallel, and closely situated.

Although not illustrated, other tooth cleaning elements, including but not limited to massage elements and elastomeric cleaning members, which can be formed to have a number of different shapes and sizes, may be used in combination with the tufts of bristles. Such tooth cleaning elements may be arranged on any portion of the head, and in many configurations.

Figure 1B:
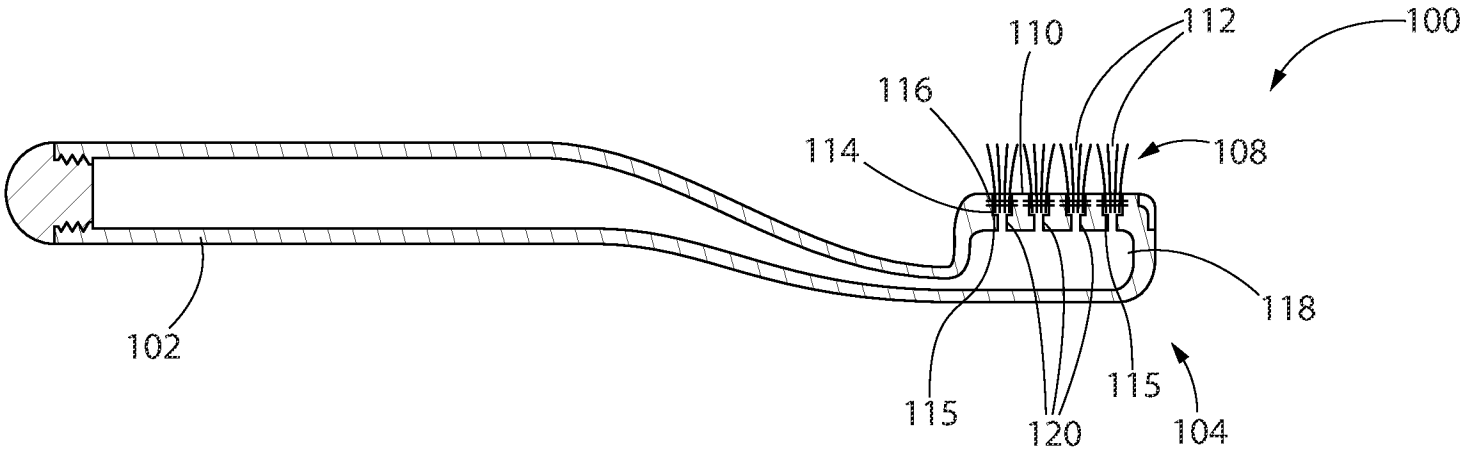
FIG. 1B is a cross-sectional view of the toothbrush of FIG. 1, taken along section line A-A in FIG. 1A.

As illustrated in more detail in FIG. 1B, each of the bristle tufts 112 is partially disposed in the tuft hole 114 formed in the top surface 110 of the head 104. In this implementation, each bristle tuft 112 is retained in a respective tuft hole 114 using a staple 116. Stapling of tufts is conventionally known, and generally includes bending a plurality of bristle filaments proximate their center and about the staple 116. The staple 116 is then secured across a diameter of the tuft hole 114, and the ends of the filaments extend out of the tuft hole, to form the bristles. Thus, in this arrangement, each bristle filament comprises two bristles, one extending from either side of the staple.

Although stapling of bristles may be conventionally known, in conventional stapling techniques the tuft holes are blind holes formed in the top surface of the solid head. Also in conventional toothbrushes, the head 104 is a solid mass. In contrast, in the embodiment of FIGS. 1A and 1B, the head comprises a housing having a continuous sidewall defining a void or cavity 118. The tuft holes 114 extend through the sidewall, e.g., from an inner surface of the sidewall to the outer surface of the sidewall, and are in fluid communication with the cavity 118. In some embodiments, the head 104 is a housing comprising one or more surfaces or plates. For example, the tuft holes may be formed in a bristle plate or head plate. The cavity 118 may be completely enclosed, with the exception of the egress provided by the tuft holes 114. In some embodiments, the tuft holes 114 may not extend all the way through the bristle plate. In these embodiments, a fluid passageway 120 may be provided between each tuft hole 114 and the cavity 118. The tuft holes 114 have a floor 115 and the fluid passageway 120 extends between the floor 115 of the tuft holes 114 and the cavity 118. The fluid passageways 120 are illustrated in FIG. 1B as being substantially co-axial with the tuft holes 114, but with a smaller diameter. This arrangement is not required. For example, in some implementations, the tuft holes 114 may extend through the head plate to the cavity 118, thereby obviating the need for the passageways 120 altogether. In still other arrangements, the fluid passageways 120 may be angled relative to the axis of the tuft holes 114. For example, the fluid passageways may open into a sidewall of the tuft hole 114. It is also not required that the fluid passageways 120 extend along a single axis. The passageways 120 may include multiple sections connected together, for example.

The cavity 118 acts as a reservoir to contain an oral care fluid therein, such as for example but not limited to a dentifrice solution. In some embodiments, the reservoir may extend along the toothbrush, into the neck 106 and/or the handle 102. As will be appreciated, the larger the cavity, the greater amount of fluid the cavity is capable of retaining. Although not illustrated in FIGS. 1A and 1B, a sealable port or other opening may be provided as access to the cavity, for example, to fill the cavity with the dentifrice or other oral care solution. In the example shown in FIG. 1B, the handle 102 includes a removable end cap 122 which may be removed to fill the cavity 118.

In operation, when the cavity is filled with a fluid, the fluid may pass through the passageways 120 and come into contact with the bristle tufts 112 disposed in the tuft holes 114. Within each tuft, the bristles are substantially parallel and closely spaced. Accordingly, capillaries exist between the bristles and those capillaries act to transfer or wick fluid from the base of the bristle tufts away from the tuft hole 114, toward a distal end of the bristles 108. Accordingly, the bristles of the toothbrush are capable of delivering the dentifrice or other oral care solution contained in the cavity to the oral cavity. This may obviate the need to manually apply the dentifrice to the distal end of the bristles. Moreover, because the number, size, and length of the bristles, as well as the spacing between bristles can be controlled, it is possible to deliver a predetermined amount of fluid via each bristle tuft.

In the toothbrush 100 illustrated in FIG. 1B, the user may bring a fluid in the cavity into contact with the bristle tufts 112 by tilting the toothbrush 100 in a manner in which the head 104 is disposed below the handle 102. Upon contact with the bristles, the fluid will fill the capillaries in the bristle tufts, thereby being ready for introduction to the oral cavity. During normal brushing, some additional fluid may be conveyed via the bristle tufts, but because the brush is normally used in a position in which the handle 102 is not above the head 104 for extended periods of time, the excess fluid may be negligible.

Although in some instances it may be possible to mold the toothbrush 100 as a unity piece, in other implementations it may be necessary to form the toothbrush from multiple pieces. For example, the top surface 110 of the toothbrush may comprise a head or bristle plate having a plurality of holes formed therethrough, with the bristle tufts 112 mounted to the head plate within the holes. The head plate may be subsequently affixed to the toothbrush, such as by adhesion, welding, or the like, to enclose the cavity.

Figure 2:
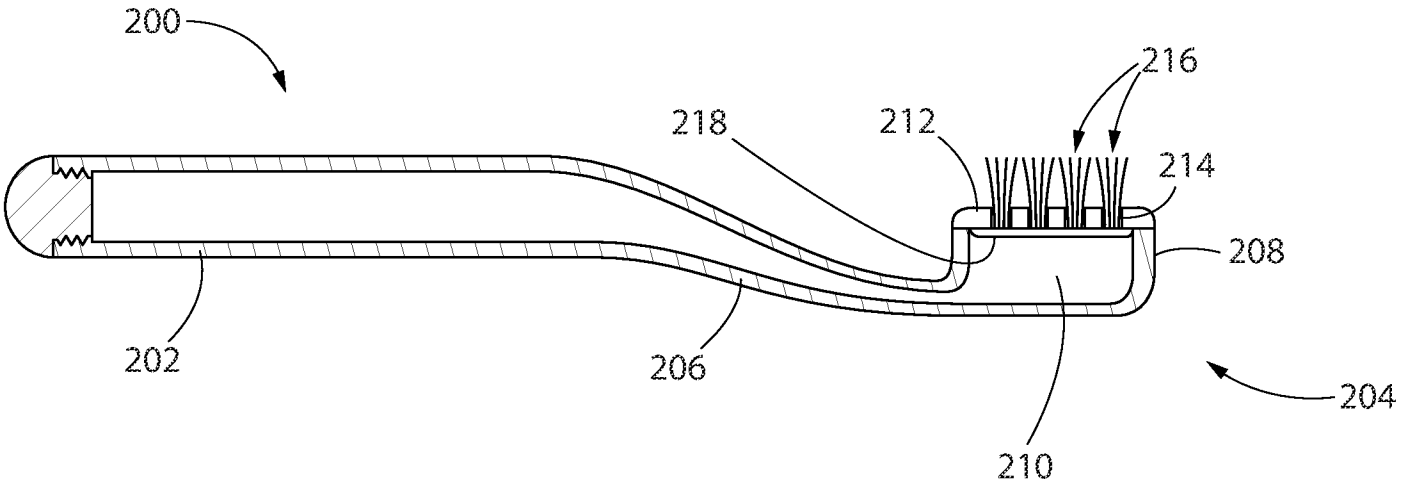
FIG. 2 is a cross-sectional view of another implementation of a toothbrush according to an example implementation of this disclosure.

FIG. 2 illustrates another example toothbrush 200 according to another example embodiment of this disclosure. The toothbrush 200 generally includes a handle 202, a head 204 disposed at the distal end of the handle 202, and a neck 206 generally disposed between the handle 202 and the head 204. As illustrated, the head 204 is generally hollow, comprising a thin sidewall 208 defining a cavity 210. In this manner, the toothbrush 200 is similar to the toothbrush 100 described above with reference to FIGS. 1A and 1B.

Also in the previous example, the toothbrush 200 includes a plurality of holes 214 formed through a top 212 of the head 204. A plurality of tufts of bristles 216 extend through the holes 214 however, instead of the tufts being held in the tuft holes 214 using staples, the tufts are formed using a technique such as anchor free tufting (AFT). In AFT a head plate or membrane is created (e.g., the top 212 of the head 204) and the tooth cleaning elements (such as bristles, elastomeric elements, and combinations thereof) are positioned into the head plate so as to extend through the holes of the head plate 212. The free ends of the tooth cleaning elements on one side of the head plate perform the cleaning function. The ends of the tooth cleaning elements on the other side of the head plate, i.e., to be disposed in the cavity 210, are melted together by heat to be anchored in place. As the tooth cleaning elements are melted together, a melt matte 218 is formed, which is a layer of plastic formed from the collective ends of the tooth cleaning elements that connects the tooth cleaning elements to one another inside the cavity and prevents the tooth cleaning elements from being pulled through the tuft holes 214.

In some conventional designs, such as some conventional manual toothbrushes, after the tooth cleaning elements are secured to the head plate, the head plate may be secured to the head 204, such as by ultrasonic welding. In some embodiments, the head plate can be molded onto the sidewall 208 of the head 204, adhered, snap-fit, or otherwise mechanically coupled to the sidewall 208 of the head 204 as desired. When the head plate is coupled to the head 204, the melt matte is located between a lower surface of the head plate and a floor of a basin or cavity of the head 204 in which the head plate is disposed. The melt matte, which is coupled directly to and in fact forms a part of the tooth cleaning elements, prevents the tooth cleaning elements from being pulled through the holes in the head plate thus ensuring that the tooth cleaning elements remain attached to the head plate during use of the oral care implement. In embodiments of this disclosure, the melt matte 218 is porous, thereby allowing fluid in the cavity to pass through the melt matte and contact the bristles for delivery outside the cavity, via capillary action between the bristles. The porosity of the melt matte 218 may result from the process by which the melt matte is formed. More specifically, because the melt matte is formed when a plurality of filament-type polymer members are melted, pores may naturally exist. Alternatively, pores may be purposefully formed through the melt matte, such as by puncturing, drilling, or other processes.

In another embodiment, the bristle tufts 216 may be connected to the head plate or membrane using a technique known in the art as AMR. In this technique, a head plate is provided, for example integrally formed with the neck and handle of the toothbrush, and the bristles are inserted into holes in the head plate so that free/cleaning ends of the bristles extend from the front surface of the head plate and bottom ends of the bristles are adjacent to the rear surface of the head plate. After the bristles are inserted into the holes in the head plate, the bottom ends of the bristles are melted together by applying heat thereto, thereby forming a melt matte at the rear surface of the head plate. The melt matte is a thin layer of plastic that is formed by melting the bottom ends of the bristles so that the bottom ends of the bristles transition into a liquid, at which point the liquid of the bottom ends of the bristles combine together into a single layer of liquid plastic that at least partially covers the rear surface of the head plate. After the heat is no longer applied, the melted bottom ends of the bristles solidify/harden to form the melt matte 218. The rear of the toothbrush head, neck, and/or handle may then be overmolded with another injected material such as, for example but not limited to, a thermoplastic elastomer (TPE) so long as a cavity or openings are maintained adjacent the porous melt matte for transport of the dentifrice or oral care solution.

Figure 3:
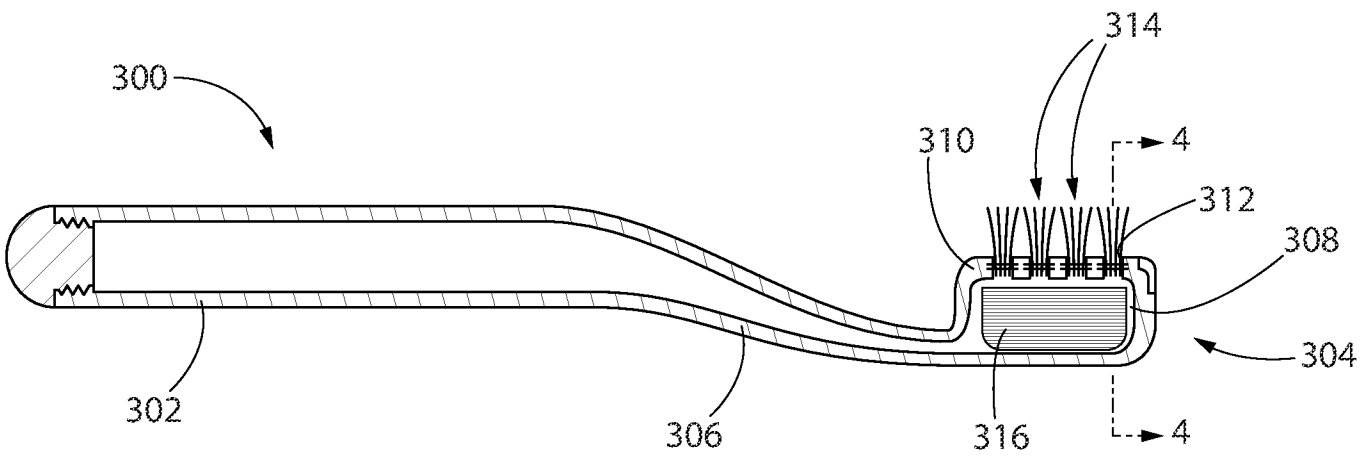
FIG. 3 is a cross-sectional view of another implementation of a toothbrush according to an example implementation of this disclosure.

FIG. 3 illustrates another example embodiment of this disclosure. In this example, a toothbrush 300 similar to the toothbrushes 100, 200 described above, includes a handle 302, a head 304 at a distal end of the handle 302 and a neck 306 extending generally between the handle 302 and the head 304. As in previous embodiments, a cavity 308 is disposed inside the head and alternatively in portions of the neck 306 and/or handle 302. Holes 312 are formed through a bristle plate 310 comprising a top portion of the head 306. The holes 312 are in fluid communication with the cavity 308. Bristle tufts 314 are disposed in the holes 312. The bristles tufts 314 may be retained in the tuft holes 312 in a manner according to any of the foregoing embodiments, e.g., using staples or other anchors, or using anchor-free methods.

Unlike the previous embodiments, however, the toothbrush 300 also includes a wick 316 disposed in the cavity 308. Although the wick 316 is generally illustrated as being disposed only in the head 304, the wick may extend into the neck and/or through the neck into the handle 302. The wick 316 is provided generally to releasably retain the dentifrice solution and/or convey the dentifrice solution from a reservoir disposed in the handle 302 to a position proximate the tuft holes 312. In some embodiments, the wick may generally comprise a plurality of capillaries arranged substantially parallel to the longitudinal axis of the toothbrush. Fluid contained in a reservoir in the handle is transported via the capillaries to a position proximate the tuft holes. Because the wick releasably retains the fluid, the wick may aid in preventing accidental discharge of the fluid from the toothbrush. For example, if the toothbrush 100, 200 of the embodiments of FIGS. 1 and 2, detailed above is left in an upside down position, i.e., with the bristles pointing down and the head below the handle, fluid may leak directly out through one or more of the tuft holes. By retaining the fluid in the wick, however, the fluid may not exit through the tuft holes under only the force of gravity.

Modifications to the toothbrush 300 also are contemplated. For example, the wick 316 may be movable between two positions, e.g., a first position contacting the bristle tufts, and a second position spaced from the bristle tufts. In the position contacting the tufts, fluid is conveyed out of the cavity 308 via the bristles 314 in the manner described above. However, in the position spaced from the bristles, there is no fluid flow between the wick and the bristles 314.

Figure 4A:
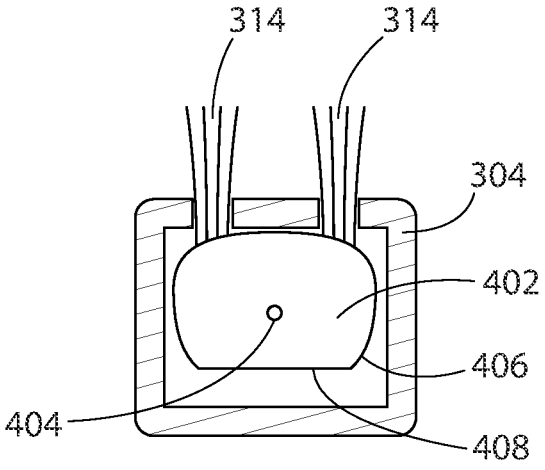
FIGS. 4A and 4B are cross-sectional views taken along section line 4-4 in FIG. 3, of an example implementation of a toothbrush according to an example implementation of this disclosure.
Figure 4B:
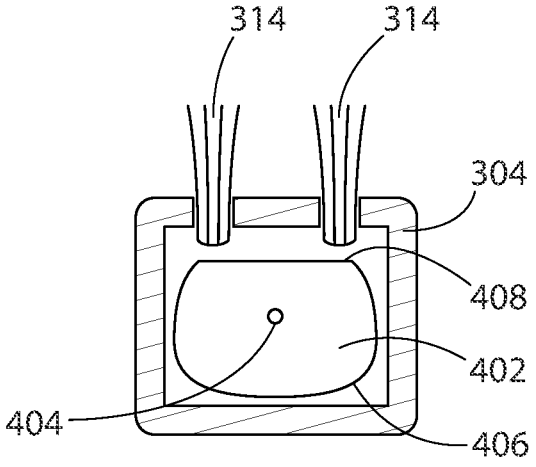

FIGS. 4A and 4B illustrate an example embodiment of a movable wick. More specifically, FIGS. 4A and 4B are cross-sectional images of the head 304 taken along section line 4-4 of FIG. 3. In these figures, a generally elongate wick 402 is disposed to rotate about an axis 404. The wick 402 includes an annular sidewall 406 and a flat sidewall 408. When the wick 402 is rotated into the position illustrated in FIG. 4A, the annular sidewall contacts the bristle tufts 314 and fluid is transferred from the wick to the bristle tufts. Then, when the wick is rotated into the position illustrated in FIG. 4 B, the bristles are spaced from the wick 402, such that fluid does not flow through the bristles 314. Although not illustrated in the figures, the toothbrush 300 may be provided with a dial or other manual interface allowing a user to move the wick 402 between the positions illustrated in FIGS. 4A and 4B.

Figure 5:
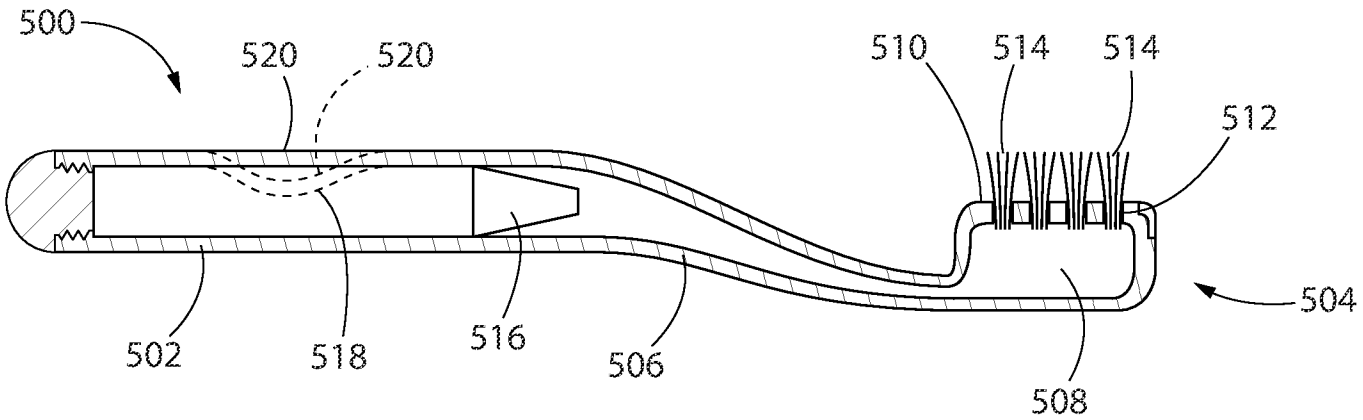
FIG. 5 is a cross-sectional view of another implementation of a toothbrush according to an example implementation of this disclosure.

FIG. 5 illustrates an example of a toothbrush 500 according to another embodiment of this disclosure. The toothbrush 500 may prevent additional dentifrice solution from exiting the toothbrush 500 in an unwanted fashion. The toothbrush 500 includes an elongate handle 502 terminating at a head 504, and a neck 506 is provided between the handle 502 and the head 504, as in previous embodiments. A cavity 508 is disposed inside the head 504. In this embodiment, the cavity extends from the head into the handle 502. Bristles tufts 514 extend from holes 512 formed in a bristle plate 510 comprising a top of the head 504. The bristles 514 may be retained in the holes 512 in any manner, including using the techniques described above. Unlike previous embodiments, the toothbrush 500 also includes a valve 516. The valve 516 preferably is a one-way valve, such as a duckbill valve. The valve 516 allows for fluid to flow from the handle into the head but preferably inhibits the flow of fluid from the head into the handle. The valve 516 may be disposed in the handle 502, the head 504, or the neck 506.

In some implementations, the portion of the cavity 508 upstream of the valve, i.e., in the handle 502, comprises a reservoir 518 and may be filled with a dentifrice solution. In use, the user may tilt the toothbrush 500 such that the handle 502 is disposed above the head 504, and gravity will pull some amount of the fluid through the valve 516 into the cavity 508 in the head. The valve 516 will then inhibit a return of the fluid from the head 504 into the reservoir 518.

In other implementations, the handle 502 of the toothbrush 500 may be provided with a mechanism for forcing an amount of fluid contained in the reservoir 518 through the valve 516. In FIG. 5, for example, a portion of the handle 502 comprises a deformable wall 520. The user may press on the deformable wall 520 to decrease a volume of the reservoir 518, thereby applying pressure that forces fluid in the reservoir 520 through the valve 516. The deformable wall 520 is illustrated in FIG. 5 in both the normal position (shown in solid lines) and a deflected or deformed position (shown in dashed lines).

Figure 6:
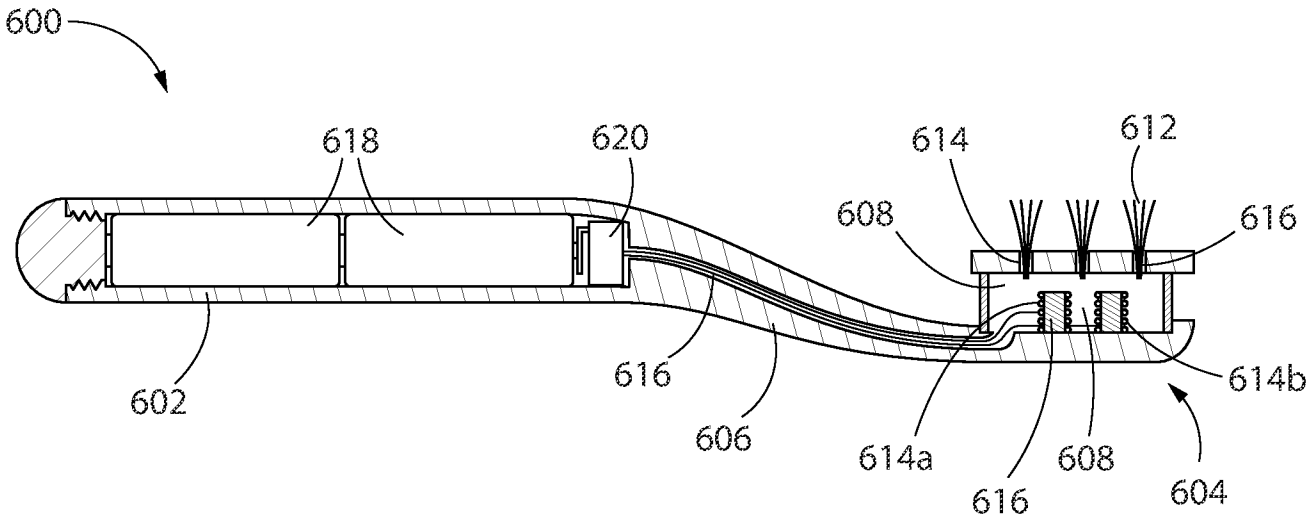
FIG. 6 is a cross-sectional another implementation of a toothbrush according to an example implementation of this disclosure.

FIG. 6 illustrates yet another embodiment of this disclosure, in which a toothbrush 600 generally includes a handle 602, a head 604, and a neck 606 disposed between the handle in the head. As in previous embodiments, a cavity 608 is provided in the head and holes 610 in which bristles 612 are retained are in fluid communication with the cavity 608. In this embodiment, however, a pair of electrodes 614*a*, 614*b* is disposed in the cavity 608. The electrodes 614*a*, 614*b* are illustrated as metallic windings about cylindrical posts 616, although in other embodiments the electrodes may be flat plates or have some other composition. The electrodes 614*a*, 614*b* are individually electrically connected, via leads 616, to a power source, embodied as a battery 618. A controller 620 is also illustrated schematically in FIG. 6. The controller 620 may control application of power and/or current from the power source 618. For example, an applied current may create an electrical field between the electrodes 614*a*, 614. In some implementations, the electrical field 614A, 614*b* may act on the dentifrice solution to provide an electrochemical benefit to the solution. For example, an active ingredient in the dentifrice may be electrochemically changed in a manner that produces an orally beneficial substance. In these embodiments, the fluid contained in the cavity 608 may act as an electrolyte to promote operation of the electrodes 614*a*, 614*b*.

In other embodiments, one of the electrodes 614*a*, 614*b* may be a sacrificial electrode, formed of a metal or other material that degrades when a difference in potential is applied across the electrodes. For example, it has been found that zinc electrodes will oxidize in the presence of an electrolyte. The electrolyte may be provided by the fluid in the cavity 608, by saliva, which may enter the cavity 608 via the holes 610 from the oral cavity of the user, or by water, which may similarly enter the cavity 608 via the holes 610, for example. When the zinc electrode oxidizes, zinc ions are released. These ions may be transported along with the fluid out of the cavity 608 via the bristles 612 in a manner described above. The zinc ions may provide an effective antibacterial, which may be in addition to any benefit provided by the dentifrice solution.

In each of the foregoing embodiments, tuft holes are provided in fluid communication with a reservoir or cavity in the head of a toothbrush containing a dentifrice or other fluid. Accordingly, bristle tufts disposed in the tuft holes are exposed to the fluid, and carry the fluid away from the cavity, via capillaries between the bristles. Thus, in each of the foregoing, it is desirable that the fluid and the bristles are compatible, i.e., they are selected such that the fluid will flow between the bristles. In some embodiments, the fluid is chosen or formulated to have a surface tension sufficient to promote wicking via the bristles. For example, water-based solutions and suspensions, liquid mouthwashes, whitening solutions, and the like, may be disposed in the reservoir. Water and saliva that enter the toothbrush may also be returned outside the toothbrush via the bristles.

As noted above, by configuring the number and size of capillaries formed between the bristles, e.g., by providing relatively longer or shorter bristles, more or fewer bristles, or the like, the brush may be designed to hold a predetermine amount of fluid retained in the bristles.

As also noted above, it may be desirable to provide measures that prevent unintended seepage of the fluid via the bristles. Some mechanical solutions, e.g., a movable wick, a one-way valve, were described above. However, it has been found that it is also possible to use the fluid to stop the flow of additional fluid between uses. More specifically, film-forming polymers may be included in a dentifrice or other oral care solution that is capable of being transported by bristles described above. For example, tests were conducted with the Formulation 1 below:

FORMULATION 1

| Ingredient | Weight % |
|---|---|
| Water | 77.90% |
| Methocel E5 | 10.00% |
| Methocel E50 | 3.00% |
| Titanium Dioxide | 2.00% |
| Propylene Glycol | 5.50% |
| Tween 80 (polysorbate 80) | 1.10% |
| Menthol | 0.50% |
| TOTAL | 100.0% |

Formulation 1 had a relative thick consistency, similar to toothpaste, and provided breath freshening in the oral cavity. Formulation 1 was transferred through the bristles via capillary action, albeit over the course of more than 1 hour. When disposed in the bristles and exposed to ambient air, the formulation hardened, to prevent additional amounts of the formulation from exiting the toothbrush via the tuft holes. Under action of the hardening, a film is formed. Moreover, upon placing the toothbrush under water or in the mouth, the film dissolved, and allowed additional flow of the formulation from within the cavity.

Additional Formulations 2-4 were also tested, and all were shown to form a film on the bristles when exposed to the ambient air to prevent additional leakage of fluid through the vent holes. However, Formulations 2-4 had lower viscosities, and thus the bristles were wetted in between 1 and 4 minutes. Breath-freshening Formulations 2-4 included:

FORMULATION 2

| Ingredient | Weight % |
|---|---|
| Water | 94.48% |
| Methocel E5 | 2.50% |
| Methocel E50 | 0.75% |
| Titanium Dioxide | 0.50% |
| Propylene Glycol | 1.38% |
| Tween 80 (polysorbate 80) | 0.28% |
| Menthol | 0.13% |
| TOTAL | 100.0% |

FORMULATION 3

| Ingredient | Weight % |
|---|---|
| Water | 87.5% |
| Methocel E5 | 10.00% |
| Propylene Glycol | 1.00% |
| Tween 80 (polysorbate 80) | 1.00% |
| Menthol | 0.50% |
| TOTAL | 100.0% |

FORMULATION 4

| Ingredient | Weight % |
|---|---|
| Water | 91.50% |
| Methocel E5 | 2.50% |
| Titanium Dioxide | 1.00% |
| Propylene Glycol | 1.00% |
| Tween 80 (polysorbate 80) | 1.00% |
| Menthol | 0.50% |
| TOTAL | 100.0% |

In the example Formulations 1-4, a film-former was included in the substance to be dispensed. In other embodiments, a film may not be formed, but a similar result may be achieved by using a dentifrice that hardens as volatiles therein dissolve in the ambient environment. For example, as volatiles in a dentifrice solution dissolve, the viscosity of the dentifrice in the bristles, i.e., exposed to the ambient environment, will decrease, blocking the flow of additional dentifrice out of the toothbrush.

Although example embodiments have been described in language specific to the structural features and/or methodological acts, the claims are not necessarily limited to the specific features or acts described. Rather, the specific features and acts are disclosed as illustrative forms of implementing the example embodiments.

What is claimed is:

1. A toothbrush comprising:

a handle;

a head coupled to the handle, the head comprising a top surface and a cavity;

an oral care fluid stored in the cavity;

at least one tuft hole extending from the top surface of the head to a floor of the tuft hole, the tuft hole having a first diameter;

a bristle tuft positioned within the tuft hole and extending from the top surface of the head;

at least one fluid passageway extending from the cavity to an opening in the floor of the tuft hole, the at least one fluid passageway having a second diameter; and wherein the first diameter is greater than the second diameter.

2. The toothbrush according to claim 1 wherein the at least one fluid passageway is coaxial with the one of the tuft holes.

3. The toothbrush according to claim 1 wherein the bristle tuft comprises a plurality of bristles that are oriented substantially parallel and closely spaced so that capillaries exist between the bristles in the bristle tuft to wick the oral care fluid from the cavity upward along the bristle tuft.

4. The toothbrush according to claim 1 further comprising a reservoir in the handle that is in fluid communication with the cavity in the head.

5. The toothbrush according to claim 1 wherein a bottom end of the bristle tuft is in contact with the floor of the tuft hole and does not extend into the fluid passageway.

6. The toothbrush according to claim 1 wherein the bristle tuft is coupled to the head using a staple.

7. The toothbrush according to claim 6 wherein the staple is positioned entirely within the tuft hole.

8. The toothbrush according to claim 1 further comprising a wick member located in the cavity and at least partially saturated with the oral care fluid.

9. The toothbrush according to claim 8 further comprising a reservoir in the handle that is in fluid communication with the cavity in the head, and wherein the wick member extends into the reservoir in the handle.

* * * * *